US005377501A

United States Patent [19]

Muston

[11] Patent Number: 5,377,501

[45] Date of Patent: Jan. 3, 1995

[54] OIL SEPARATOR FOR CONDITIONING RECOVERED REFRIGERANT

[75] Inventor: Robert L. Muston, Victoria, Australia

[73] Assignee: Environmental Products Amalgamated Pty Ltd, Victoria, Australia

[21] Appl. No.: 952,894

[22] PCT Filed: Apr. 30, 1991

[86] PCT No.: PCT/AU91/00182

§ 371 Date: Nov. 20, 1992

§ 102(e) Date: Nov. 20, 1992

[87] PCT Pub. No.: WO91/19140

PCT Pub. Date: Dec. 12, 1991

[30] Foreign Application Priority Data

May 25, 1990 [AU] Australia ..... PK 0312
May 25, 1990 [AU] Australia ..... PX 0313

[51] Int. Cl.[6] ..... F25B 45/00

[52] U.S. Cl. ..... 62/292; 62/475; 62/470; 62/472; 55/421; 55/426

[58] Field of Search ..... 62/470, 472, 474, 475, 62/195, 84, 292, 149; 55/337, 379, 421, 426, 466

[56] References Cited

U.S. PATENT DOCUMENTS

| | | | |
|---|---|---|---|
| 2,749,723 | 6/1956 | Webber . | |
| 3,324,680 | 6/1967 | Cremer . | |
| 3,520,149 | 7/1970 | Uratani . | |
| 4,476,688 | 10/1984 | Goddard | 62/149 |

FOREIGN PATENT DOCUMENTS

| | | |
|---|---|---|
| 144743 | 4/1950 | Australia . |
| 1028269 | 2/1953 | France . |
| 733969 | 4/1943 | Germany . |
| 1501021 | 1/1972 | Germany . |
| 2308481 | 8/1973 | Germany . |
| 576921 | 4/1946 | United Kingdom . |

*Primary Examiner*—John M. Sollecito
*Attorney, Agent, or Firm*—Peterson, Wicks, Nemer & Kamrath

[57] ABSTRACT

A refrigerant filter/accumulator and an oil separator, both suitable for refrigerant recovery equipment, are disclosed. In the filter/accumulator (10) refrigerant enters (11), is filtered by cup-shaped filter (15), and liquid-refrigerant drains into accumulator section (20). Superheated refrigerant from compressor (17) passes through pipe (21, 22, 23) and vaporises refrigerant which leaves the unit via outlet (26). Accumulated oil can be drained when desired via oil port (35). In another embodiment refrigerant enters section (20) and passes upwardly through a coarse filter and baffle [both depending from ledge (30)] before encountering filter (15) and exiting from the upper section of the unit. In the oil separator (not shown) superheated refrigerant enters a vessel at a lowpoint and must flow up in a tortuous path through a mesh, thus prompting settlement of oil. The settled oil exits through a continuously open, flow restricted line which returns it to upstream of the compressor, thus enabling pressure equalisation across the compressor after shutdown.

20 Claims, 2 Drawing Sheets

OIL SEPARATOR FOR CONDITIONING RECOVERED REFRIGERANT

Figure 1:
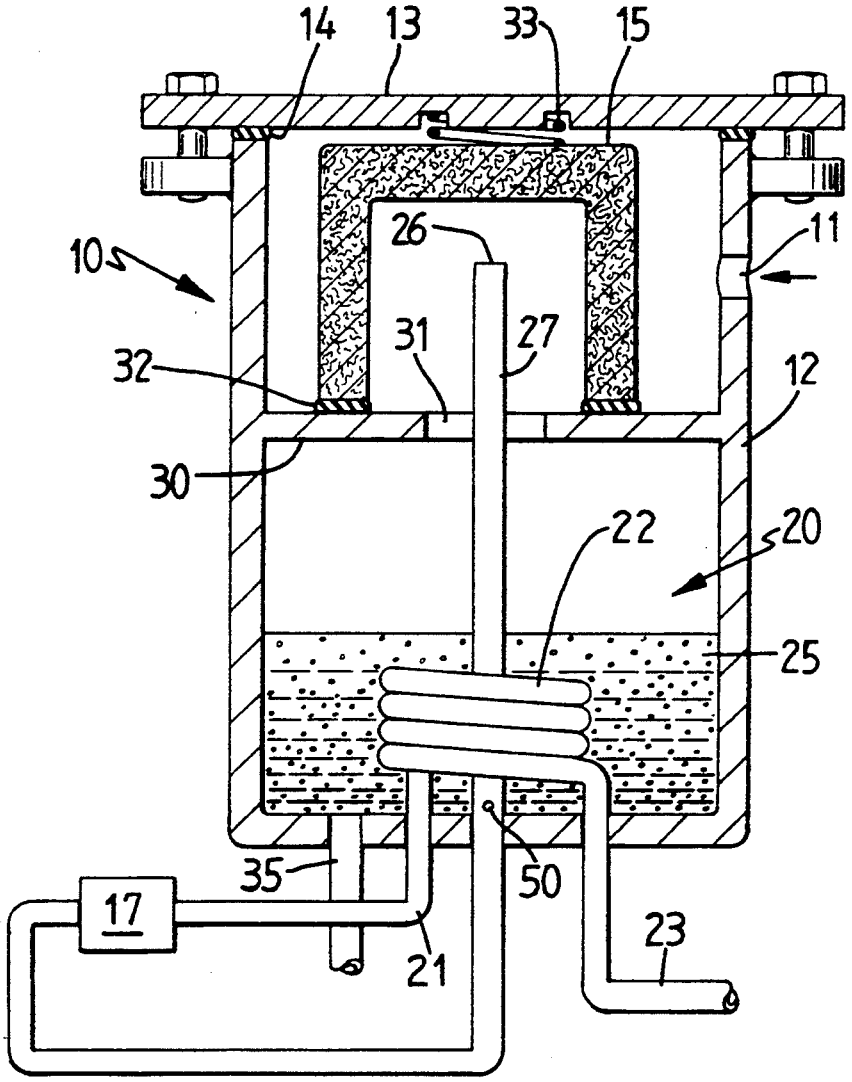

This invention relates to apparatus for processing or treating or handling fluids, particularly refrigerant gas.

In a normal refrigerant utilising system, e.g. a refrigeration plant or air conditioning system, using CFC's as the refrigerant, the filter and accumulator are provided at separate locations in the system. Therefore they have always been manufactured and installed as separate items and oil collection may need to be carried out at both locations.

Also, in a normal refrigerant utilising system using common refrigerants, the compressor lubricating oil is carried in the system with the refrigerant and eventually returns to the compressor. The amount of oil in a system varies depending on the length and diameter of plumbing and other variables and is calculated to effectively lubricate the compressor.

In certain systems, it has been found that oil tended to build up at particular spots and impair the performance of the system and also reduce the oil available for lubricating the compressor. For these applications, an oil separator was developed in which oil was caused to settle out from the refrigerant by means of baffles and/or screens and when sufficient oil has built up, a float would cause a valve to open and the oil would be forced under pressure back to an oil reservoir or compressor crankcase.

The oil separators are usually placed in the high pressure outlet line of the compressor and are usually only found on systems of one horsepower or larger due to their high cost.

In the use of "Refrigerant Recovery Equipment" (RRE), a continual closed refrigerant circuit is not used because the compressor is used to pump refrigerant from an external refrigeration or air conditioning system into a storage cylinder. On certain types of RRE, the compressor is used to pump refrigerant from the storage cylinder, through a purification system and back into the cylinder.

Because in RRE oil is collected from the refrigerant before it enters the compressor and is disposed of in other ways, any oil leaving the compressor with the refrigerant will not be returned to the compressor unless an oil separator is used.

It is an object of the present invention to provide a refrigerant gas conditioner enabling a reduction in space requirements for a system utilising the gas conditioner and savings in components to be achieved.

It is a further and preferred object according to the invention to enable lubricant collection to be carried out at a reduced number of locations.

According to the present invention there is provided a refrigerant gas conditioner for conditioning refrigerant gas upstream of an associated compressor, the conditioner being characterised by: a housing, an inlet in the housing for admitting refrigerant including refrigerant in liquid phase, an accumulator section in the housing for receiving refrigerant from the inlet and for collecting a volume of refrigerant in the liquid phase together with oil and allowing the refrigerant to separate from the oil by vaporisation, a vapour outlet in the housing through which refrigerant in vapour phase from the accumulator section passes out of the housing, a filter element through which refrigerant entering the inlet must pass before reaching the vapour outlet, the filter element being arranged within the housing and located above the accumulator section so as to drain any oil separated by the filter into the accumulator section of the housing by gravity, and an oil port in the accumulator section through which oil passes from the accumulator section out of the housing.

Preferably there is provided a heating pipe in the accumulator section, the heating pipe being arranged to receive superheated high pressure refrigerant from the associated compressor so that the compressed refrigerant from the high pressure side of the compressor passes through the heating pipe and the superheat is yielded to the liquid phase refrigerant in the accumulator section without condensation of the superheated refrigerant occurring.

In a first possible embodiment, the filter element is located in an upper portion of the housing, the inlet also being located in an upper portion of the housing so that refrigerant passes through the filter element in passing to the accumulator section, the vapour outlet being elevated above the accumulator stage and being located on the downstream side of the filter element relative to the inlet. In this embodiment, the filter element may rest on a support ledge extending inwardly from the walls of the housing, oil collected and separated by the filter element draining from the support ledge into the accumulator section located below the support ledge. The filter element may comprise an inverted cup shaped element, the outlet comprising an outlet tube extending up into and opening at the top of the tube within the inverted cup shaped filter element.

In a second alternative embodiment, the filter element is located in an upper portion of the housing and is arranged to drain oil separated thereby into a lower portion of the housing where the accumulator section is located, the inlet being provided in a lower portion of the housing so that refrigerant enters the inlet directly into the accumulator section, the vapour outlet being located in an upper portion of the housing and downstream of the filter element relative to the inlet so that refrigerant in the vapour phase passes from the accumulator section upwardly through the filter element and thence to the vapour outlet. In this embodiment, the filter element may rest on a support ledge extending inwardly from the walls of the housing, oil collected and separated by the filter element draining from the support ledge into the accumulator section located below the support ledge. The filter element may be of generally inverted cup shape and may be located above the accumulator section so that refrigerant in the vapour phase passes upwardly into the inverted cup shaped filter element and passes therethrough to reach the vapour outlet. A coarse filter element comprising a filter gauze and associated baffle may be located above the accumulator section and above the inlet and below the filter element so that refrigerant in the vapour phase passes upwardly through the coarse filter element before reaching the filter element, oil separated by the coarse filter draining into the accumulator section.

An oil port communicating with the accumulator section may be provided, the oil port enabling collection of oil separated in the accumulator section and also drained from the filter element into the accumulator section, the oil port being selectively opened to enable collection of oil.

An oil return port may communicate with the accumulator section and open into a vapour line extending from the vapour outlet, whereby oil collected in the accumulator section can be returned to an associated compressor together with refrigerant in the vapour phase passing from the vapour outlet through the vapour line.

The present invention also provides a refrigerant recovery apparatus having a compressor for compressing refrigerant recovered from an associated external refrigerating or air conditioning system, a condensor for receiving high pressure refrigerant from the compressor and for condensing the same, a refrigerant collection vessel for collection of liquid phase refrigerant from the condensor, the refrigerant recovery apparatus being characterised by a refrigerant conditioner according to the present invention, the refrigerant conditioner being connected so as to receive refrigerant from the external system through the inlet to the housing, the vapour outlet of the conditioner being connected to an inlet of the compressor, the high pressure outlet of the compressor passing superheated compressed vapour phase refrigerant through a heat exchange pipe passing through the accumulator section of the conditioner, the high pressure refrigerant then being passed in the vapour phase to the condensor.

Figure 2:
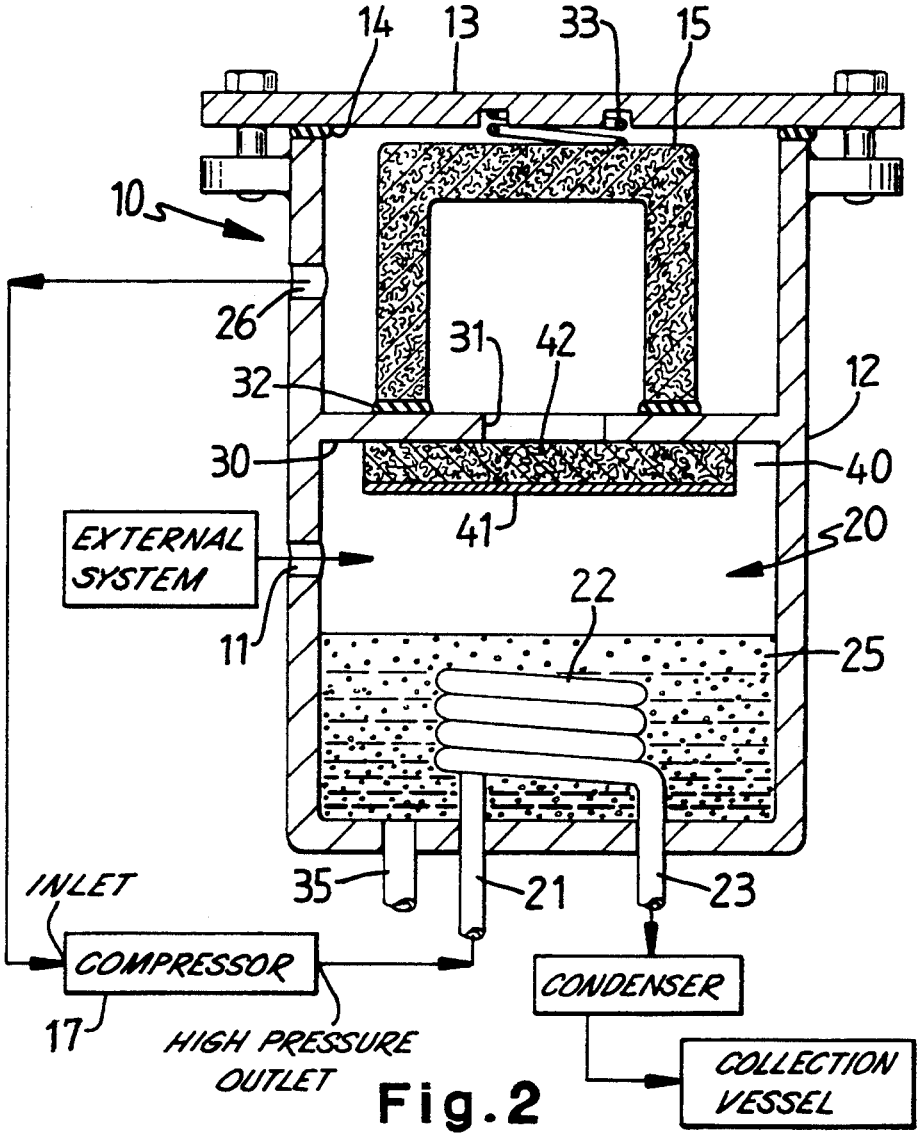

Possible and preferred features of the present invention will now be described with particular reference to the accompanying drawings. However it is to be understood that the features illustrated in and described with reference to the drawings are not to be construed as limiting on the scope of the invention. In the drawings:

FIG. 1 shows a sectional view through a gas conditioner according to the present invention, and FIG. 2 shows a sectional view of an alternative possible embodiment of a gas conditioner according to the invention.

Referring to FIG. 1, the gas conditioner as illustrated is particularly useful for refrigerant recovery equipment (RRE) receiving refrigerant gas from an external system such as a refrigerator or air conditioning plant being drained for servicing or repair. In this situation, oil must be removed from the refrigerant prior to the refrigerant entering the compressor of the RRE.

In FIG. 1 there is a conditioner 10 which provides both filtering and accumulator functions and has other advantages.

Refrigerant that is being either recycled from a storage cylinder and being cleaned, or is being recovered from an external system containing refrigerant enters through refrigerant inlet 11 in the housing 12. Refrigerant passes through the filter element 15 which is in the form of an inverted cup shaped element. The filter element 15 functions to remove contaminants from the refrigerant, including particulate contaminants, water and lubricating oil. The liquid phase refrigerant and/or other matter that passes through the filter 15 accumulates in the accumulator section 20 in the bottom of the housing 12.

Superheated refrigerant from the high pressure side of an associated compressor 17 enters through high pressure inlet 21, the superheated refrigerant passing through heating pipe 22 shown as a coil located in the accumulator section 20. Heat is yielded by the refrigerant so as to cause or assist vaporisation of the liquid refrigerant in the accumulator section 20. High pressure refrigerant leaves through high pressure outlet 23.

The liquid phase refrigerant 25 in the accumulator section 20 vaporises and the vapour passes upwardly through the opening 31 in the support ledge 30 and enters outlet 26 which opens into the upper portion of the housing 12 within the filter element 15. Refrigerant can pass from the pipe 27 to the associated compressor for example.

When all of the refrigerant 25 has been vaporised, the residual matter in the accumulator section 20 will be substantially entirely lubricant oil and this can be drained selectively through oil port 35. The oil can be measured if required to check the oil content of the refrigerant and/or enable re-charging of the associated refrigerant system with the required amount of oil.

The housing 12 may be provided with a permanent filter element 15 that is disposed of together with the housing 12. Alternatively the cover 13 may be removable so that the element 15 can be replaced.

The support ledge 30 supports the filter element and enables any oil separated by the filter to be drained inwardly through the aperture 31 and into the accumulator section 20. Gasket 32 is provided around the lower edge of the filter element to prevent refrigerant by-passing the element. A spring 33, or other biasing means, at the top of the filter element acts between the cover 13 and the filter element 15 and press the element downwardly onto the ledge 30. Gasket 14 is provided between the cover 13 and the housing 12.

In the alternative possible embodiment illustrated in FIG. 2, the same reference numerals are used for corresponding parts. The inlet 11 in FIG. 2 is provided in the lower accumulator section 20 of the housing 12 so that refrigerant and contaminants and oil enter the accumulator section 20. Refrigerant vapour passes upwardly through the aperture 31 in the support ledge 30 and passes through the filter 15 to the outlet 26 formed in the open upper end of an outlet tube 27 provided in the upper portion of the housing 12.

A coarse filter element 40 is interposed between the top of the accumulator section 20 and the aperture 31 so that refrigerant vapour and any contaminants being carried thereby must first pass through the coarse filter 40 before reaching the main filter element 15. The coarse filter 40 rests on a baffle 41 so that refrigerant vapour must pass around the edges of the baffle 41 and pass through a substantial length of the filter 40 before reaching the aperture 31. The filter 40 may comprise a gauze material, e.g. made of copper. The filter 40 functions to separate contaminants including contaminants which can be drained back into the accumulator section 20 upstream of the filter element 15. This will prolong the effective life of the filter element 15.

The gas conditioner illustrated in FIGS. 1 and 2 does not substitute for any filtration which may be placed on the high pressure side of the associated compressor 17 if that is needed.

By closing the inlet port 11 and running the associated compressor 17 until the high pressure side of the compressor equals atmospheric pressure, the filter element 15 may be replaced with virtually no loss of refrigerant to atmosphere.

The refrigerant gas conditioner according to the invention enables oil collection which is important in RRE where oil may be contaminated and must be prevented from entering the compressor. If oil enters the compressor the level may rise to a point where damage to the compressor or at least performance reduction of the compressor occurs.

By collecting the oil that has been removed with the refrigerant from the external system being serviced, the correct amount of oil to be added back into that system can be determined.

The gas conditioner described herein can remove at least 99% of oil and therefore it is suited particularly for RRE. If the gas conditioner is used in a refrigerant utilising system, such as a refrigerator or air conditioning plant, it can have a small bleed hole at the point marked 50 in FIG. 1, so that the oil can return to the compressor as is desirable in a closed refrigeration system.

The combined functions of accumulator and filter achieved by the gas conditioner is both efficient and space saving and is more economical to manufacture and use.

I claim:

1. A refrigerant recovery apparatus for recovering refrigerant from an associated external refrigerating or air conditioning system comprising, in combination:

a compressor for compressing refrigerant and having an inlet and a high pressure outlet;

a condenser for receiving high pressure refrigerant and for condensing the same;

a refrigerant collection vessel connected so as to collect liquid phase refrigerant from the condenser; and a refrigerant conditioner for conditioning refrigerant gas including:

a housing;

an inlet in the housing connected so as to receive refrigerant from the external system and for admitting refrigerant including refrigerant in liquid phase into the housing;

an accumulator section in the housing for receiving refrigerant from the inlet and for collecting a volume of refrigerant in the liquid phase together with oil and allowing the refrigerant to separate from the oil by vaporisation of the refrigerant, a vapour outlet in the housing through which refrigerant in vapour phase from the accumulator section passes out of the housing, with the vapour outlet of the conditioner being connected to said inlet of the compressor;

a filter element through which refrigerant entering the inlet must pass before reaching the vapour outlet, the filter element being arranged within the housing and located above the accumulator section so as to drain any oil separated by the filter into the accumulator section of the housing by gravity;

a heating pipe in the accumulator section having an inlet and an outlet, with the inlet of the heating pipe being connected to said high pressure outlet of the compressor so as to receive superheated high pressure vapour phase refrigerant from the compressor so that the compressed refrigerant from the high pressure outlet of the compressor passes through the heating pipe and superheat is yielded to the liquid phase refrigerant in the accumulator section without condensation of the superheated refrigerant occurring in the heating pipe, with the outlet of the heating pipe being connected to the condenser so that the high pressure refrigerant passes in the vapour phase from the heating pipe to the condenser; and an oil port in the accumulator section through which oil passes from the accumulator section out of the housing.

2. A conditioner as claimed in claim 1 characterised in that there is provided an oil return port communicating with the accumulator section and opening into a vapour line extending from the vapour outlet, whereby oil collected in the accumulator section can be returned to an associated compressor together with refrigerant in the vapour phase passing from the vapour outlet through the vapour line.

3. A conditioner as claimed in claim 1 characterised in that the filter element is located in an upper portion of the housing, with the inlet also being located in the upper portion of the housing so that refrigerant passes through the filter element in passing to the accumulator section, with the vapour outlet being elevated above the accumulator section and being located on the downstream side of the filter element relative to the inlet.

4. A conditioner as claimed in claim 3 characterised in that the filter element rests on a support ledge extending inwardly from the walls of the housing, with the oil collected and separated by the filter element draining from the support ledge into the accumulator section located below the support ledge.

5. A conditioner as claimed in claim 3 characterised in that the filter element comprises an inverted cup shaped element, with the outlet comprising an outlet tube extending up into and opening at the top of the tube within the inverted cup shaped filter element.

6. A conditioner as claimed in claim 1 characterised in that the filter element is located in an upper portion of the housing and is arranged to drain oil separated thereby into a lower portion of the housing where the accumulator section is located, with the inlet being provided in the lower portion of the housing so that refrigerant enters the inlet directly into the accumulator section, with the vapour outlet located in the upper portion of the housing and downstream of the filter element relative to the inlet, and with the filter element located intermediate the accumulator section and the vapour outlet so that refrigerant in the vapour phase passes from the accumulator section upwardly through the filter element and thence to the vapour outlet.

7. A conditioner as claimed in claim 6 characterised in that the filter element rests on a support ledge extending inwardly from the housing, with the oil collected and separated by the filter element draining from the support ledge into the accumulator section located below the support ledge.

8. A conditioner as claimed in claim 6 characterised in that the filter element is of generally inverted cup shape and is located above the accumulator section so that refrigerant in the vapour phase passes upwardly into the inverted cup shaped filter element and passes through the filter element to reach the vapour outlet.

9. A conditioner as claimed in claim 6 and further characterised by a coarse filter element comprising a filter gauze and associated baffle located above the accumulator section and above the inlet and below the filter element so that refrigerant in the vapour phase passes upwardly through the coarse filter element before reaching the filter element, with the oil separated by the coarse filter element draining into the accumulator section.

10. A conditioner as claimed in claim 1 characterised in that the oil port enables collection of oil separated in the accumulator section and also drained from the filter element into the accumulator section, with the oil port being selectively opened to enable collection of oil.

11. A conditioner as claimed in claim 9 wherein the course filter element comprises, in combination: a filter guaze, and a baffle for supporting the guaze and having a peripheral edge, with the baffle preventing refrigerant flow therethrough and requiring the refrigerant to pass around the peripheral edge of the baffle to the filter guaze.

12. A conditioner as claimed in claim 11 wherein the filter element rests on a support ledge having an aperture, with the course filter element located below the support ledge, with the filter guaze positioned intermediate the support ledge and the baffle so that the refrigerant vapour must pass through a substantial length of the filter guaze before reaching the aperture.

13. A conditioner as claimed in claim 12 wherein the filter element is of a generally inverted cup shape, with the refrigerant passing upwardly from the accumulator section through the aperture into the inverted cup shape and passes through the filter element to reach the vapour outlet.

14. A conditioner as claimed in claim 1 further characterised by a coarse filter element located above the accumulator section and above the inlet and below the filter element so that refrigerant in the vapour phase passes upwardly through the coarse filter element before reaching the filter element, with the oil separated by the coarse filter element draining into the accumulator section.

15. A conditioner as claimed in claim 14 wherein the course filter element comprises, in combination: a filter guaze, and a baffle for supporting the guaze and having a peripheral edge, with the baffle preventing refrigerant flow therethrough and requiring the refrigerant to pass around the peripheral edge of the baffle to the filter guaze.

16. A conditioner as claimed in claim 6 further characterised by a coarse filter element located above the accumulator section and above the inlet and below the filter element so that refrigerant in the vapour phase passes upwardly through the coarse filter element before reaching the filter element, with the oil separated by the coarse filter element draining into the accumulator section.

17. A conditioner as claimed in claim 16 wherein the course filter element comprises, in combination: a filter guaze, and a baffle for supporting the guaze and having a peripheral edge, with the baffle preventing refrigerant flow therethrough and requiring the refrigerant to pass around the peripheral edge of the baffle to the filter guaze.

18. A conditioner for conditioning refrigerant gas comprising, in combination: a housing having an upper portion and a lower portion; an accumulator section in the lower portion of the housing for collecting a volume of refrigerant in the liquid phase together with oil; means to heat the refrigerant to thereby separate it from the oil by vaporisation; a filter element in the upper portion of the housing and located above the accumulator section so as to drain any oil separated by the filter into the accumulator section of the housing by gravity; an oil port in the accumulator section through which oil passes from the accumulator section out of the housing; means in the lower portion of the housing and upstream of the filter element for admitting refrigerant including refrigerant in the liquid phase directly into the accumulator section, with the admitting means comprising an inlet; and a vapour outlet located in the upper portion downstream of the filter element, with the filter element located intermediate the accumulator section and the vapour outlet so that refrigerant in the vapour phase passes from the accumulator section upwardly through the filter element and thence to the vapour outlet.

19. A conditioner as claimed in claim 18 characterised in that the filter element rests on a support ledge extending inwardly from the walls of the housing, with the support ledge having an aperture with the oil collected and separated by the filter element draining from the support ledge through the aperture into the accumulator section located below the support ledge.

20. A conditioner as claimed in claim 19 wherein the filter element is of a generally inverted cup shape, with the refrigerant passing upwardly from the accumulator section through the aperture into the inverted cup shape.

* * * * *